US009102448B2

(12) United States Patent
Skelton et al.

(10) Patent No.: US 9,102,448 B2
(45) **Date of Patent: *Aug. 11, 2015**

(54) TAMPER-EVIDENT CLOSURE

(75) Inventors: Steven Andrew Skelton, Clackmannanshire (GB); Alexander Donald Meiklem McPherson, Falkirk (GB); James Harrower, Sterling (GB)

(73) Assignee: OBRIST CLOSURES SWITZERLAND GMBH, Reinach (CH)

( * ) Notice: Subject to any disclaimer, the term of this patent is extended or adjusted under 35 U.S.C. 154(b) by 1262 days.

This patent is subject to a terminal disclaimer.

(21) Appl. No.: 12/664,961

(22) PCT Filed: Jul. 10, 2008

(86) PCT No.: PCT/GB2008/002377

§ 371 (c)(1), (2), (4) Date: May 5, 2011

(87) PCT Pub. No.: WO2009/010722

PCT Pub. Date: Jan. 22, 2009

(65) Prior Publication Data

US 2011/0259844 A1 Oct. 27, 2011

(30) Foreign Application Priority Data

Jul. 13, 2007 (GB) ..... 0713711.0

(51) Int. Cl.

*B65D 41/34* (2006.01)
*B65D 55/02* (2006.01)
*B65D 49/04* (2006.01)

(52) U.S. Cl.

CPC ..... *B65D 55/022* (2013.01); *B65D 49/04* (2013.01); *B65D 55/026* (2013.01)

(58) Field of Classification Search

USPC ..... 215/21, 44, 329, 330, 331, 252, 277, 215/230; 220/259.3, 259.4; 222/81, 83

See application file for complete search history.

(56) References Cited

U.S. PATENT DOCUMENTS 1,798,151 A 3/1931 Fabrice
2,858,054 A 10/1958 Harkrader (Continued)

FOREIGN PATENT DOCUMENTS

DE 809 896 8/1951
DE 861 666 1/1953

(Continued)

OTHER PUBLICATIONS

International Search Report dated Feb. 27, 2008; UK Application No. GB 0721330.9; 4 pages.

(Continued)

*Primary Examiner* — Fenn Mathew
*Assistant Examiner* — James N Smalley
(74) *Attorney, Agent, or Firm* — Andrew F. Young, Esq.; Lackenbach Siegel, LLP

(57) ABSTRACT

A tamper-evident closure for a container is provided. The closure comprises a first portion including inner and outer parts, and a second portion. The outer part is movable relative to the inner part from a first position in which at least part of the first and second portions are adjacent each other, to a second position in which there is a gap therebetween. The first portion comprises locking means for irreversibly locking the closure in the second position upon first opening so that the gap cannot be closed. The outer part includes a top plate and at least part of the locking means is carried on or by the plate.

16 Claims, 12 Drawing Sheets

(56) References Cited

U.S. PATENT DOCUMENTS

| | | | | |
|---|---|---|---|---|
| 3,348,718 | A | 10/1967 | Musy | |
| 3,412,890 | A | 11/1968 | Rich | |
| 3,425,578 | A | 2/1969 | Owens | |
| 3,455,479 | A | 7/1969 | Wilton | |
| 3,603,470 | A | 9/1971 | Armour | |
| 3,810,556 | A | 5/1974 | Coursaut | |
| 3,820,683 | A | 6/1974 | Jasinski | |
| 3,871,545 | A | 3/1975 | Bereziat | |
| 3,892,351 | A | 7/1975 | Johnson et al. | |
| 4,091,949 | A | 5/1978 | Fowles et al. | |
| 4,303,171 | A | 12/1981 | Schremmer | |
| 4,310,105 | A | 1/1982 | Gach | |
| 4,531,649 | A | 7/1985 | Shull | |
| 4,569,464 | A | 2/1986 | Wassilieff | |
| 4,637,519 | A | 1/1987 | Dutt et al. | |
| 4,697,719 | A | 10/1987 | Allen | |
| 4,744,480 | A | 5/1988 | Luch et al. | |
| 4,790,442 | A | 12/1988 | Gach | |
| 4,838,441 | A | 6/1989 | Chernack | |
| 4,941,592 | A | 7/1990 | Kitterman | |
| 4,942,970 | A | 7/1990 | Jay | |
| 5,004,126 | A | 4/1991 | Klesius | |
| 5,332,113 | A | 7/1994 | Kusler et al. | |
| 5,427,260 | A | 6/1995 | Mueller et al. | |
| 5,445,824 | A | 8/1995 | Someya | |
| 5,588,545 | A | 12/1996 | King | |
| 5,603,422 | A | 2/1997 | Herrmann | |
| 5,683,016 | A | 11/1997 | Santagiuliana | |
| 5,738,231 | A | 4/1998 | Montgomery | |
| 5,819,965 | A | 10/1998 | King et al. | |
| 6,036,036 | A | 3/2000 | Bilani et al. | |
| 6,095,375 | A | 8/2000 | Adams et al. | |
| 6,269,986 | B1 | 8/2001 | Gross | |
| 6,484,879 | B2 | 11/2002 | Desmarais et al. | |
| 6,683,038 | B2 | 1/2004 | Forth et al. | |
| 6,685,046 | B2 | 2/2004 | Ogino | |
| 6,688,501 | B2 | 2/2004 | DeGroot et al. | |
| 6,727,215 | B2 | 4/2004 | Roberts et al. | |
| 6,866,164 | B2 | 3/2005 | Branson et al. | |
| 6,880,729 | B2 | 4/2005 | Stull et al. | |
| 6,908,013 | B2 * | 6/2005 | Thomson et al. | 222/153.06 |
| 7,121,419 | B2 | 10/2006 | Ferry et al. | |
| 7,125,828 | B2 | 10/2006 | Catlin et al. | |
| 7,204,383 | B2 | 4/2007 | Hsu | |
| 2002/0125249 | A1 | 9/2002 | Baird-Smith et al. | |
| 2004/0026420 | A1 | 2/2004 | Smith | |
| 2004/0143505 | A1 | 7/2004 | Kovach | |
| 2005/0115915 | A1 * | 6/2005 | Thomson | 215/252 |
| 2005/0133475 | A1 | 6/2005 | Goto et al. | |
| 2005/0205607 | A1 | 9/2005 | Hierzer et al. | |
| 2006/0011573 | A1 | 1/2006 | Herald et al. | |
| 2006/0043052 | A1 | 3/2006 | Lin | |
| 2006/0077062 | A1 | 4/2006 | Andrechak et al. | |
| 2006/0124646 | A1 | 6/2006 | Gugliemini et al. | |
| 2008/0190880 | A1 | 8/2008 | Needham | |
| 2008/0277613 | A1 | 11/2008 | Ramsey et al. | |
| 2009/0173007 | A1 | 7/2009 | Fogg | |
| 2009/0289027 | A1 * | 11/2009 | Torrent Ortega | 215/352 |
| 2010/0170898 | A1 * | 7/2010 | Skelton et al. | 220/214 |
| 2010/0308054 | A1 * | 12/2010 | Goria et al. | 220/315 |

FOREIGN PATENT DOCUMENTS

| | | | |
|---|---|---|---|
| DE | 85 35 205 | U | 2/1986 |
| DE | 3 605 963 | | 8/1987 |
| DE | 200 19 797 | U1 | 5/2001 |
| EP | 0 127 943 | A1 | 12/1984 |
| EP | 0 132 792 | A1 | 2/1985 |
| EP | 0 179 498 | A1 | 4/1986 |
| EP | 0 236 136 | A2 | 9/1987 |
| EP | 0 306 670 | A2 | 3/1989 |
| EP | 0 337 568 | A2 | 10/1989 |
| EP | 0 414 462 | A2 | 2/1991 |
| EP | 0 593 952 | A1 | 9/1993 |
| EP | 0 619 243 | A1 | 10/1994 |
| EP | 0 688 723 | A1 | 12/1995 |
| EP | 1 101 707 | A1 | 5/2001 |
| EP | 1 266 839 | A | 12/2002 |
| EP | 1 266 839 | A2 | 12/2002 |
| EP | 1 283 175 | A2 | 2/2003 |
| EP | 1 161 382 | B1 | 9/2003 |
| EP | 2005/053085 | | 6/2004 |
| EP | 0 425 391 71 | | 6/2005 |
| EP | 1 694 576 | B1 | 2/2008 |
| EP | 1 786 698 | B1 | 9/2008 |
| EP | 1 663 809 | B1 | 10/2008 |
| FR | 2 439 139 | A | 5/1980 |
| FR | 2 567 106 | A | 1/1986 |
| FR | 2 591 571 | A | 6/1987 |
| GB | 1 298 084 | A | 11/1972 |
| GB | 1 473 482 | | 5/1977 |
| GB | 1484517 | | 9/1977 |
| GB | 2 123 392 | A | 2/1984 |
| GB | 2 136 782 | A | 9/1984 |
| GB | 2 148 235 | A | 5/1985 |
| GB | 2 158 424 | A | 11/1985 |
| GB | 2 172 803 | A | 10/1986 |
| GB | 2 222 821 | | 3/1990 |
| GB | 2 264 110 | B | 8/1993 |
| GB | 2 311 283 | A | 9/1997 |
| GB | 2 355 269 | A | 4/2001 |
| GB | 2 356 842 | A | 6/2001 |
| GB | 2 375 516 | A | 11/2002 |
| GB | 2399339 | | 9/2004 |
| GB | 2 430 667 | A | 4/2007 |
| GB | 2 415 426 | | 5/2007 |
| GB | 2 432 153 | | 11/2007 |
| JP | 10 338251 | A | 3/1999 |
| JP | 2000/229651 | | 8/2000 |
| JP | 2003160162 | A | 11/2001 |
| WO | WO 94/07470 | A1 | 4/1994 |
| WO | WO 99/57031 | A1 | 11/1999 |
| WO | WO 00/26878 | A1 | 5/2000 |
| WO | WO 00/66451 | A1 | 11/2000 |
| WO | WO 01/36290 | A1 | 5/2001 |
| WO | WO 01/83668 | A1 | 11/2001 |
| WO | WO 02/44047 | A1 | 6/2002 |
| WO | WO 02/085730 | | 10/2002 |
| WO | WO 02/096771 | A1 | 12/2002 |
| WO | WO 03/016162 | A1 | 2/2003 |
| WO | WO 03/016165 | A1 | 2/2003 |
| WO | WO 2004/011347 | | 2/2004 |
| WO | WO 2005/024745 | A2 | 3/2005 |
| WO | WO 2005/049443 | | 6/2005 |
| WO | WO 2006/000532 | A1 | 1/2006 |
| WO | WO 2006/003168 | | 1/2006 |
| WO | WO 2006/008285 | | 1/2006 |
| WO | WO 2006/020059 | A2 | 2/2006 |
| WO | WO 2006/117505 | | 11/2006 |
| WO | WO 2007/125292 | A2 | 11/2007 |
| WO | WO 2009/056829 | A1 | 5/2009 |

OTHER PUBLICATIONS

PCT Serial No. PCT/GB2008/002377 filed Jul. 10, 2008, Internat'l Search Report and Written Opinion, 11 pgs.

Serial No. PCT/EP2005/053441, completed Dec. 1, 2005, International Search Report and Written Opinion of the International Searching Authority, 5 pages.

Serial No. PCT/EP2003/07798, mailed Oct. 15, 2004, International Search Report and Written Opinion of the International Searching Authority, 5 pages.

EP 1 663 809 B1 Documents related to EP Opposition (EP Patent Granted)—8 pages.

U.S. Appl. No. 10/577,575, filed Sep. 5, 2006, Skelton.

U.S. Appl. No. 12/664,961, filed Dec. 16, 2009, Skelton.

U.S. Appl. No. 12/666,630, filed Mar. 5, 2010, Skelton.

* cited by examiner

TAMPER-EVIDENT CLOSURE

CROSS REFERENCE TO RELATED APPLICATIONS

This application claims priority from PCT Patent Application Serial No. PCT/GB2008/002377, filed Jul. 10, 2008, the entire contents of which are herein incorporated fully by reference, and based on Great Britain Patent Application Serial No. 0713711.0 filed Jul. 13, 2007.

FIGURE FOR PUBLICATION

FIG. 6A.

BACKGROUND OF THE INVENTION

1. Field of the Invention

The present invention relates generally to a closure for a container. More specifically, the present invention relates to a closure with means for indicating that a closure has been opened at least once.

2. Description of the Related Art

There is an increasing demand for tamper-indicating systems which ensure that a container is not re-filled with non-original contents. Whilst it is relatively easy to produce some form of tamper-evidence, it is much more difficult to provide tamper-evidence which cannot be either overcome without causing the tamper-evidence system to activate, or activate and then return to a virtually visually identical state so as to appear non-activated.

A particularly useful method of providing tamper-evidence is to use a system in which a closure is initially located in a first position, but once removed can only be returned to a second position which is visually distinct from the first.

U.S. Pat. No. 5,738,231 describes a closure with a part which is moved during the opening process so that following opening it cannot pass back over projection on a container finish. The result is that the closure can only return to position which is axially displaced with respect to its original position.

WO 02/096771 describes a closure in which two parts are initially adjacent each other and during the opening process the structure of the closure is changed so that a gap is generated between the two parts as a visual indication that the closure has been opened at least once.

WO 2005/049443 and WO 2006/117505 also describe closures which generate a gap to indicate they have been opened at least once. In this case the gap is unobstructed. In other words, two parts of the closure are held apart without the requirement an obstruction.

What is not appreciated by the prior art is that such tamper-evident systems are only effective if they cannot be reversed. For example, in systems which use an obstructing member to hold two parts apart it is possible to cut the obstruction member to allow a gap to be closed. WO 2005/049443 and WO 2006/117505 describe closures which generate unobstructed gaps following relative rotation of one part with respect to another. The closures are provided with some internal mechanism for preventing the two parts from being rotated back to their original relative positions. For example, ratchet arrangements present on the side walls of the parts can be used to prevent unwanted rotation. Such "lateral" ratchet arrangements have been found to be defeatable if sufficient reverse turning torque is applied.

Accordingly, there is a need for an increased level of resistance to re-setting such gap-generating closures to reduce the risk that the gap can be re-closed after first opening.

ASPECTS AND SUMMARY OF THE INVENTION

An aspect of the present invention is to provide an increased level of resistance to re-setting gap-generating closures for containers to reduce the risk that the gap can be re-closed after first opening.

The present invention relates to a tamper-evident closure for a container. The closure comprises a first portion, including inner and outer parts, and a second portion. The outer part is movable relative to the inner part from a first position in which at least part of the first and second portions are adjacent each other, to a second position in which there is a gap therebetween. The first portion comprises locking means for irreversibly locking the closure in the second position upon first opening so that the gap cannot be closed. The outer part includes a top plate and at least part of the locking means is carried on or by the plate.

The inner part may include a top plate as well; and, part of the locking means may be carried on, or by, the plate. Additionally, the locking means may comprise or include a ratchet arrangement.

In one embodiment both the inner and outer parts have respective top plates which include corresponding ratchet parts that engage to prevent relative rotation of the parts. This type of ratchet arrangement may be referred to as a longitudinal ratchet arrangement, as opposed to known lateral arrangements which are positioned on side walls.

The second portion may be adapted to be connected to a container and the first portion may comprise a cap. Certain industries demand closures with a first portion comprising a cap and a second portion comprising a sleeve which is connected to a container; for example the spirits industry.

The closure may further comprise a fitment such as a non-return fitment. Alternatively the first portion may be adapted to engage a fitment associated with the container. Certain industries, in particular the spirits industry, demand additional measures to prevent tampering. In-bore fitments, such as non-return fitments, are often fitted to containers to prevent re-filling regardless of other tamper-proofing measures.

The closure may include means for preventing the inner part from moving relative to the second portion until it has reached the second position.

The gap may be unobstructed. This means that the closure would not have to rely on an obstructing member becoming trapped. By forming an unobstructed gap it is not possible to defeat the tamper-evidence by a simple cutting operation. The gap may be formed at the respective adjacent peripheries of the portions. The inner part may include a section which extends beyond the outer part towards the second portion in the second position; the part may be positioned so as to be visible through the gap.

The second portion may be permanently fixed in its position on the container. This can be used to prevent the second portion from being moved to close the gap.

The first portion may further include a lateral ratchet arrangement for locking the inner and outer parts in the second position. This provides increased resistance to re-setting.

The first portion may include engagement formations and the lateral ratchet arrangement is located above the formations. The first portion may include formations, such as screw threads, for engaging the container or in-bore fitment. In such cases the ratchet arrangement or other locking mechanism may be located above the formations so as to increase the difficulty in accessing and tampering with the locking arrangement.

The above, and other aspects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
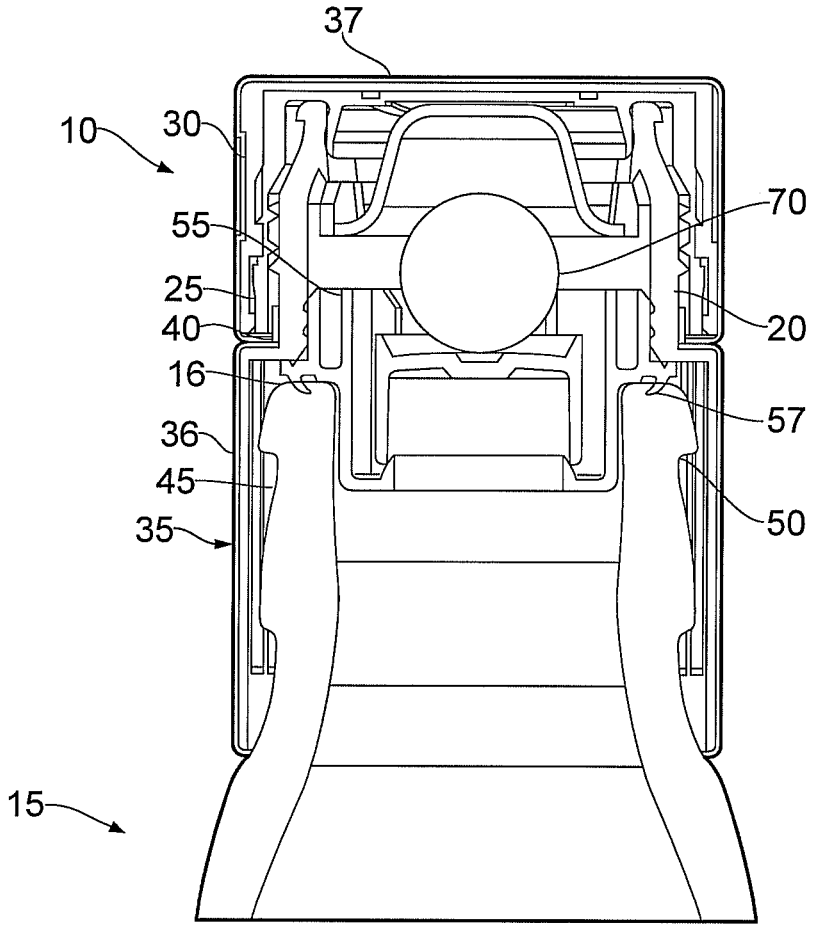
FIG. 1 is a section of a closure formed according to the present invention in a first, unopened position.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, and below may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

Referring first to FIG. 1, there is shown a closure 10 secured onto a container neck 15.

The closure 10 comprises a main body 20, an inner part 25 and an outer part 30. A metal shell 35 forms an outer casing to the closure and is divided into a cylindrical lower part 36 and a cup-shape second part 37. The parts 36, 37 are separated at a split line 40 formed by a cutting process once the shell 35 has been applied to the first and second portions of the closure 10.

Together, the body 20 and the shell part 36 comprise a second portion and the inner and outer parts plus the shell part 37 comprise a cap-like first portion.

The main body 20 is fixed onto the container neck 15 by clips 45 which project inwardly and engage under a shoulder 50. A valve housing 55 is clipped into the main body 20 and includes a sealing lip 57 which seals against the top surface 16 of the container neck 15.

A float valve 65 is housed in the housing 55 and can seal against a valve seat 60 to prevent re-filling of the container. A valve control ball 70 is located on top of the float valve 65.

In use, the second part 37 of the shell 35 is rotated. This unscrews the outer part 30 from the inner part 25. The outer part unscrews until a locking mechanism, described in more detail below, locks it to the inner part 25. With the outer and inner parts locked together, the inner part 25 can then be unscrewed from the main body 20.

When the cap (shell part 37/outer part 30/inner part 25) is screwed back onto the main body 20, a gap G is formed between the first and second shell parts 36, 37. This is because the outer part 30 cannot be screwed completely back down onto the inner part 25 by virtue of the locking mechanism. In addition, the bottom of the inner part 25 protrudes below the bottom of the outer part 30 so as to be visible in the gap G. The gap G formed between the shell parts 36, 37 is unobstructed in the sense that there is no obstruction member trapped between the parts 36, 37.

Figure 4A:
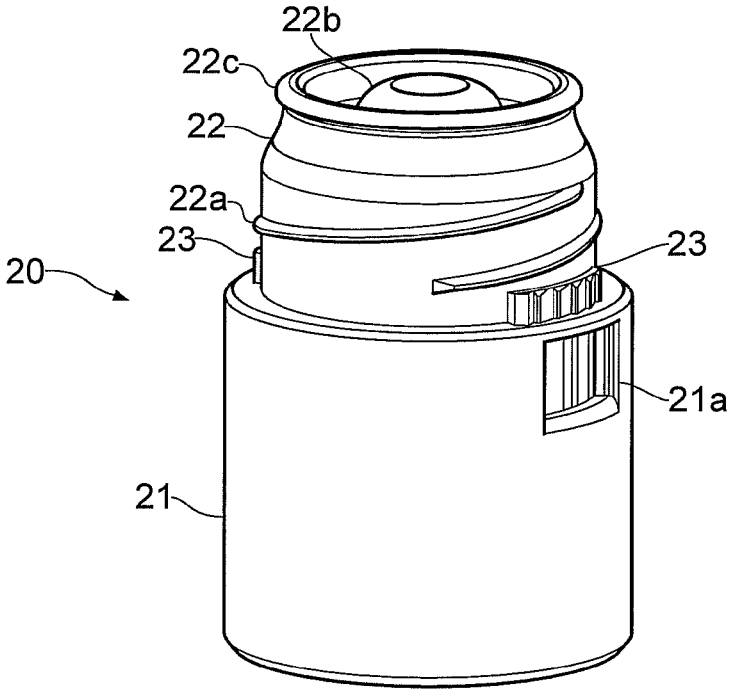
FIG. 4A is a perspective view of a second portion of the closure.
Figure 4B:
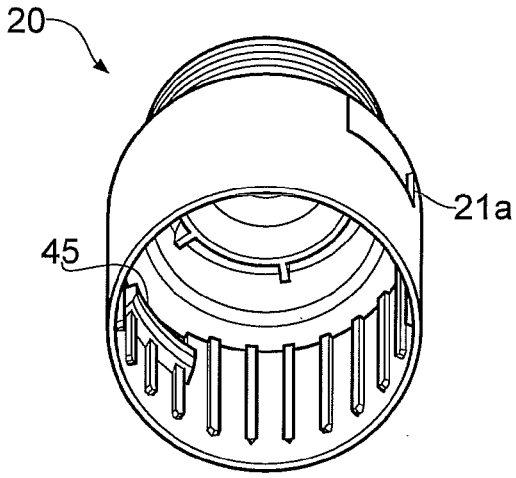
FIG. 4B is an underside perspective view of the second portion shown in FIG. 4A.

Referring now to FIGS. 4A and 4B the main body 20 is shown in more detail.

Figure 2:
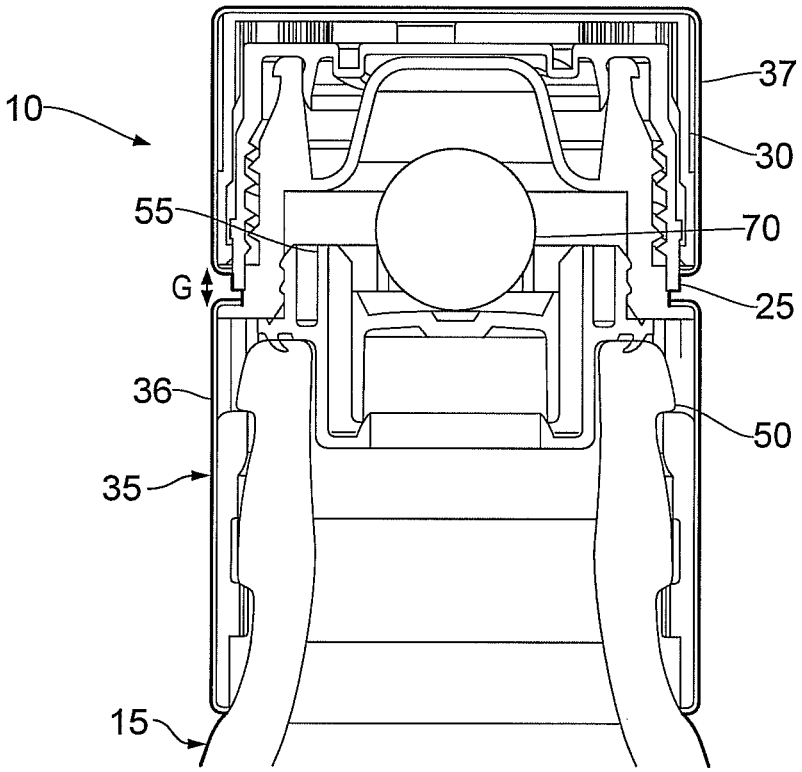
FIG. 2 is a section of the closure of FIG. 1 shown in a second, opened position.
Figure 3:
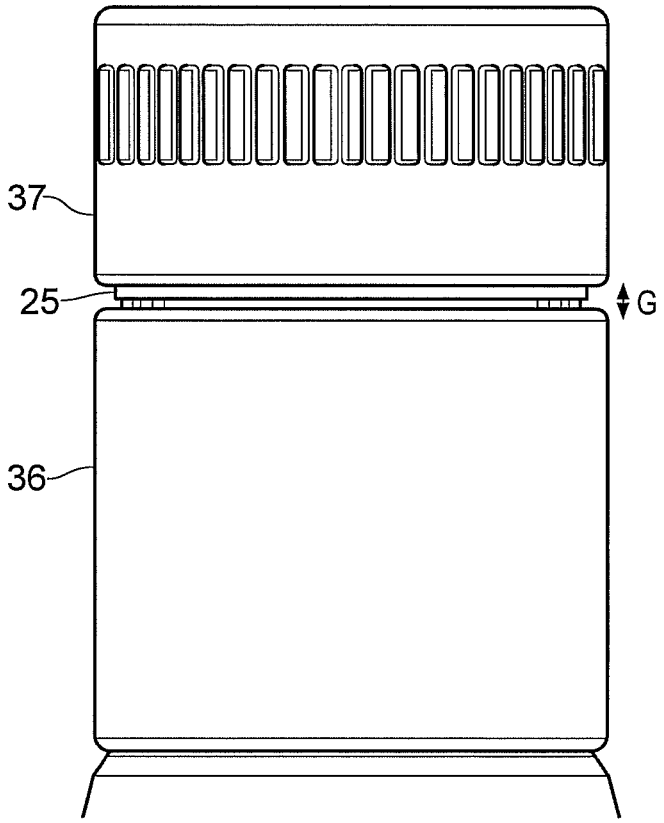
FIG. 3 is a side elevation of the opened closure shown in FIG. 2.

The body 20 comprises a lower engagement portion 21 and an upper flow regulation portion 22. The lower portion 21 comprises a generally cylindrical body having two diametrically opposed windows 21*a* each of which has at a lower edge a ledge 45 for engagement under the container neck shoulder 50 as is shown in FIGS. 1 and 2. In addition, the interior surface of the lower portion 21*a* has a plurality of mutually spaced axial ribs 21*b* which lock onto the outer surface of the container neck to prevent relative rotation between the container neck and the body 20.

The upper portion 22 of the main body 20 is generally frusto-conical in shape and has external screw threads 22*a*. At the base of the portion 22, where it joins the portion 21, two sets of ratchet teeth 23 are positioned. The teeth 23 engage corresponding teeth on the inner part 25 to prevent it from rotating while the outer part 30 is being rotated for the first time in use. Only after the outer part 30 has locked against the inner part 25 can the inner part 25 be rotated relative to the body 20. At the opposite end of the portion 22, a dome-shape flow regulator 22*b* is positioned in the aperture. The aperture itself is defined by a circumferential pouring lip 22*c*.

Figure 5A:
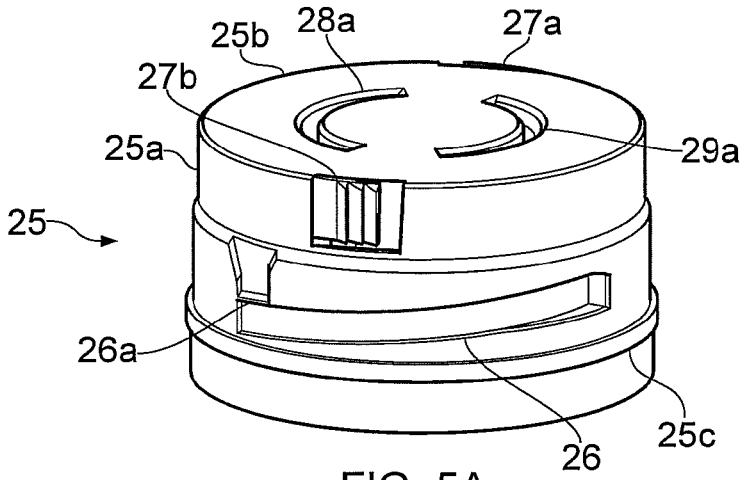
FIG. 5A is a perspective view of a first portion inner part of the closure.
Figure 5B:
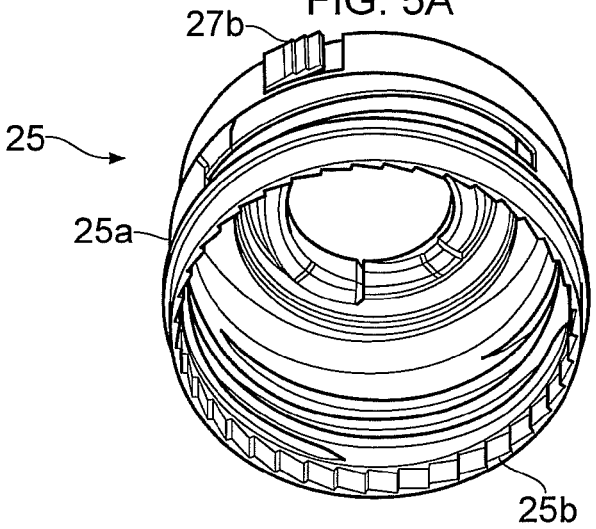
FIG. 5B is an underside perspective view of the inner part of FIG. 5A.
Figure 5C:
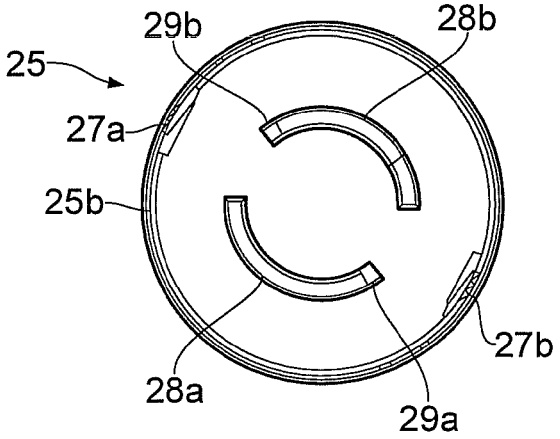
FIG. 5C is a plan view of the inner part shown in FIG. 5A.

Referring now to FIGS. 5A to 5C, the inner part 25 is shown in more detail.

The inner part 25 is generally cup-shape with a cylindrical side wall 25*a* closed at one end by a top plate 25*b*. The interior surface of the open end of the sidewall 25*a* includes a continuous series of ratchet teeth 25*b* which engage the ratchets 23 on the main body portion 22.

The exterior of the sidewall 25*a* includes two inclined side ramps 26. At the start of each ramp 26 is a locking step 26*a* the purpose of which will be described in more detail below. The sidewall 25*a* also comprises a pair of ratchet members 27*a*, 27*b* adjacent the top plate 25*b*. The exterior surface of the sidewall 25*a* also comprises a circumferential bead 25*c* the purpose of which will be described in more detail below.

The top plate 25*b* comprises a pair of opposing arcuate ramps 28*a*, 28*b* each of which terminates with a locking recess 29*a*, 29*b*.

Figure 6A:
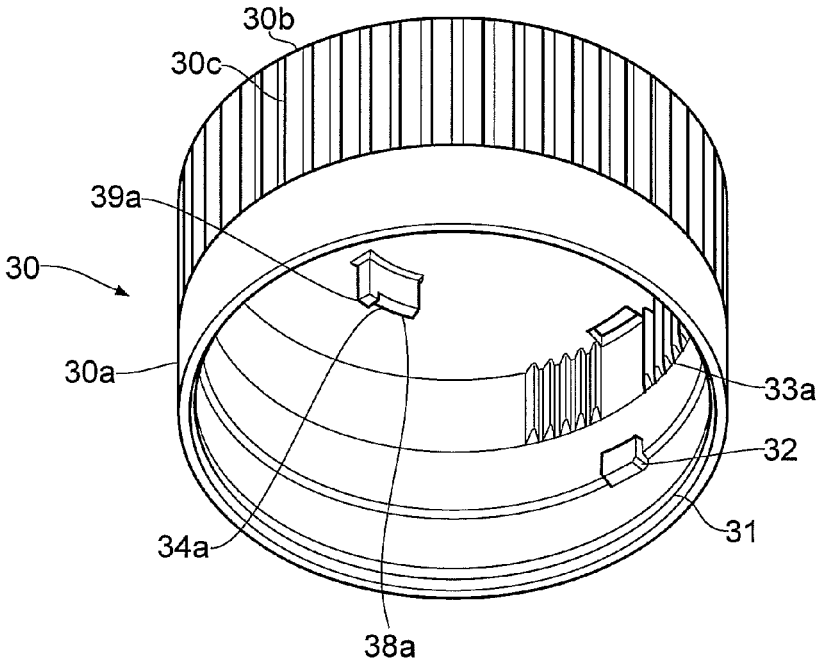
FIG. 6A is an underside perspective view of a first portion outer part of the closure.
Figure 6B:
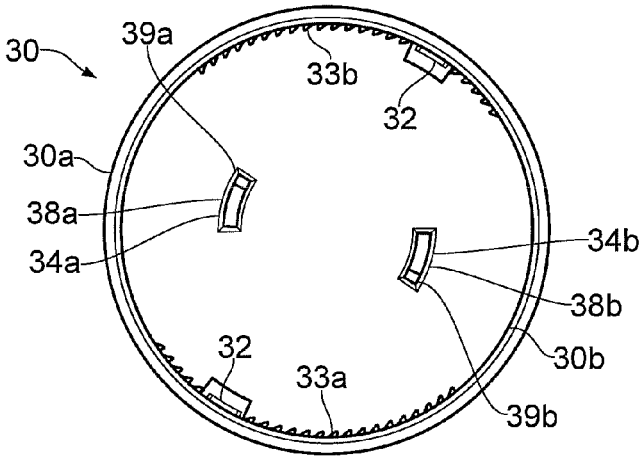
FIG. 6B is an under planned view of the outer part of FIG. 6A.

Referring now to FIGS. 6A and 6B, the outer part 30 is shown in more detail.

The part 30 is generally cup-shape and comprises a cylindrical side wall 30*a* and a top plate 30*b*. The exterior of the part 30 comprises a plurality of knurls 30*c* which help to lock the shell part 37 and to prevent relative rotation.

The interior of the sidewall 30*a* comprises a circumferential bead 31 for preventing the outer part 30 being lifted off the inner part by engagement with the corresponding bead 25*c*.

The interior of the sidewall 30*a* also comprises a pair of drive dogs 32 which engage in the ramps 26 of the inner part 25 and ride up them as the outer part 30 is rotated relative to the inner part 25.

The interior of the side wall 38 also comprises a pair of diametrically opposed ratchet arrangements 33*a*, 33*b* designed and positioned to run over and lock onto the corresponding ratchet arrangements 27*a*, 27*b* on the inner part 25 to prevent counter rotation.

The underside of the top plate 30*b* includes a pair of drive dogs 34*a*, 34*b* each of which comprises a main body 38*a*, 38*b* and a locking tooth 39*a*, 39*b*.

Figure 7A:
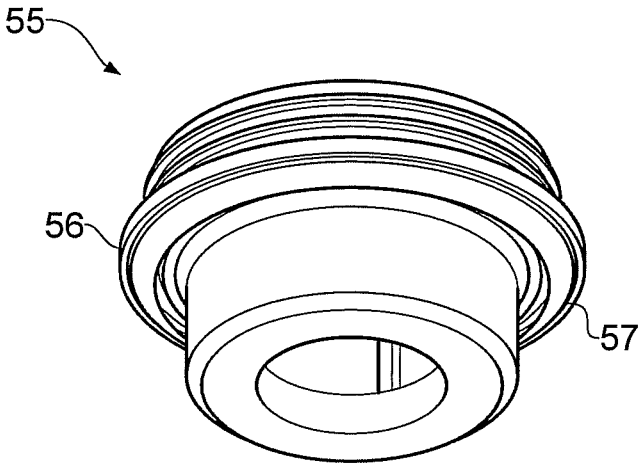
FIG. 7A is a perspective view of a valve housing forming part of the closure.
Figure 7B:
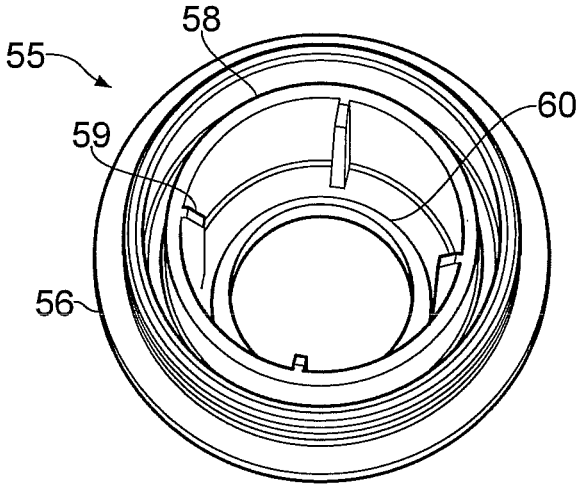
FIG. 7B is a further perspective view of the valve housing of FIG. 7A.

Referring now to FIGS. 7A and 7B a valve housing 55 is shown in more detail.

The housing 55 comprises a generally cylindrical body having a circumferential sealing flange 56 with a depending sealing lip 57 (sometimes referred to as a "crab's claw"). The exterior of the housing includes two circumferential beads 61, 62 which are used to clip the housing into the body 20 (as is shown in FIG. 1). The interior of the housing 55 comprises a valve chamber 58 having four locating ribs 59 and a valve seat 60.

Figure 8A:
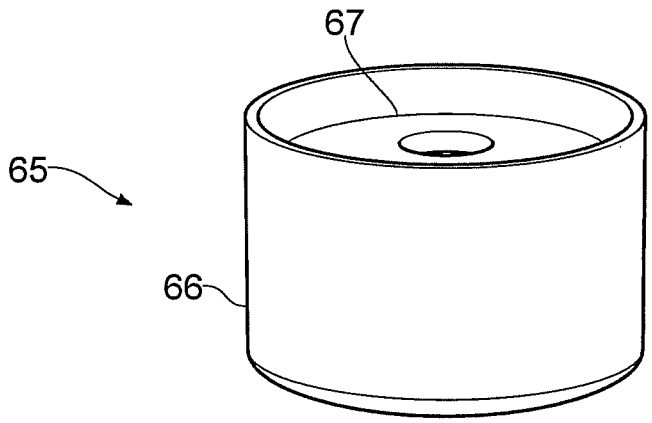
FIG. 8A is a perspective view of a valve member forming part of the closure.
Figure 8B:
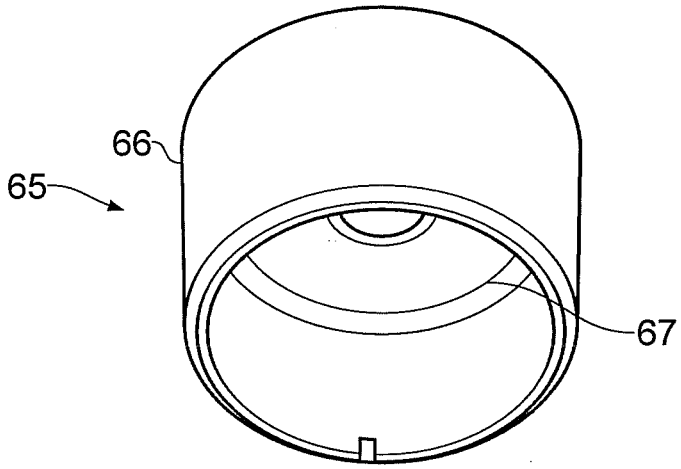
FIG. 8B is a further perspective view of the valve member of FIG. 8A.

Referring now to FIGS. 8A and 8B a float valve 65 is shown in more detail. The valve 65 comprises a generally cup-shape body comprising a cylindrical side wall 66 and a recessed top plate 67.

The operation of the closure will now be described in more detail.

Initially the body 20 is locked on to the neck 15 by the ribs 21*b* to prevent axial and rotational movement. The inner part 25 cannot rotate relative to the body 20 by virtue of the ratchets 23, 25*b*. The shell part 37 cannot rotate relative to the outer part by virtue of the knurls 30*c*. The outer part 30 cannot be lifted off the inner part 25 by virtue of the locking beads 25*c*, 31 and by virtue of the drive dogs 32 engaging under the steps 26*a*.

The shell part 37 is grasped by a user and turned. This causes the outer part 30 to rotate relative to the inner part 25. The drive dogs 32 in the outer part rise up the ramps 26 in the inner part and the drive dogs 34*a* rise up the ramps 28*a*, 29*a*. The ratchets 33*a* pass over the ratchets 27*a*, 27*b*.

The outer part is caused to rise by 2 mm. At this point, continued rotation causes the locking teeth 39*a*, 39*b* to drop into the locking recesses 29*a*, 29*b*. In addition, the ratchets 33*a* have rotated beyond the ratchets 27*a*, 27*b*. The inner part drops back down by 0.5 mm. Continued rotation of the outer part, relative to the inner part, is not possible because the drive dogs 32 abut against the end of the ramps 26, and the drive dogs 34*a*, 34*b* abut against the end of the ramps 28*a*, 28*b*.

In this second position, the open end of the outer part 30 has moved axially away from the open end of the inner part 25 to expose the free end of the sidewall 25*a*.

Continued rotation of the cap part (the shell part 37, the outer part 30 and in the inner part 25) overcomes the torque required to allow the ratchets 25 to pass over the ratchets 23 which causes the inner part to rotate relative to the body. The internal screw threads 25*d*, on the inner part, rise up the external screw threads 22*a* of the body. The cap part can now be lifted off the body 20 to allow the contents of the container to be dispensed.

The contents are dispensed through the valve housing 55. The valve 65 lifts off the seat 60 as the container is upturned and contents flow out. The valve 65 re-seals against the seat 60 under the weight of the ball 70 when the container is returned to an upright position. This prevents re-filling of the container.

When the cap part is returned, the inner part 25 is screwed back onto the body 20. The inner part screws back down to its original position, but the outer part cannot because it is locked in position both by the axial locking means provided by the drive dogs 34*a*, 34*b* and the lateral locking means provided by the ratchets 33*a*, 33*b* and 27*a*, 27*b*. This means that the gap G is formed between the shell parts 36, 37 with free end of the inner part skirt visible through it. This irreversible opening event provides visual evidence that the closure has been opened at least once. The gap G cannot be closed without destroying the closure.

Because the gap G, between the metal shell parts 36, 37, is not generated by placing an obstruction directly between them, it is not possible to close the gap G by a simple cutting operation.

By providing the dual axial and lateral ratchet arrangements, re-setting closure back to its original position to close the gap G is prevented. In an alternative embodiment (not shown), a similar closure is provided with just such an axial ratchet arrangement.

Figure 10:
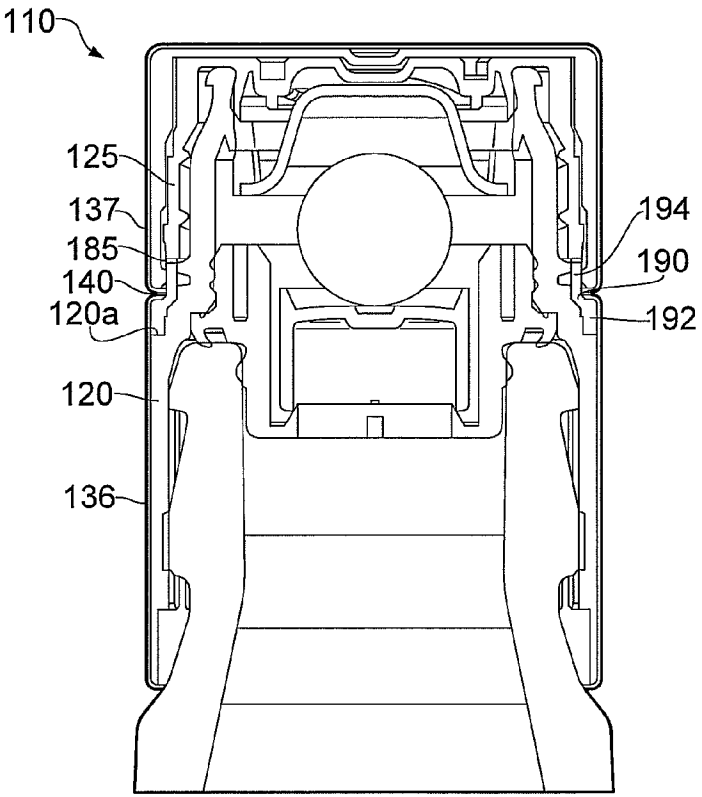
FIG. 10 is a section of the closure shown in FIG. 9.
Figure 9:
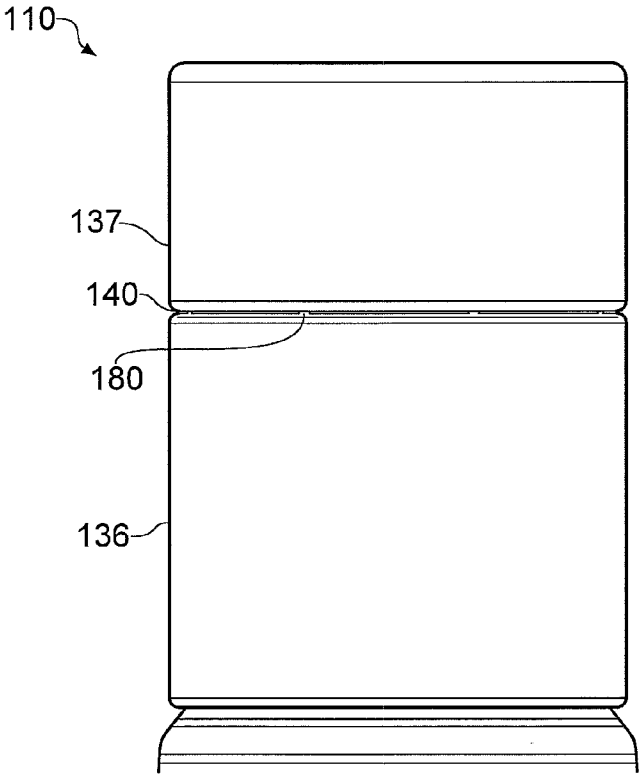
FIG. 9 is a side elevation of a closure formed according to an alternative embodiment.

Referring now to FIGS. 9 and 10 there is shown a closure 110 formed according to an alternative embodiment. The closure 110 is similar to the closure 10 illustrated in FIGS. 1 to 8.

In this embodiment, the upper and lower shell parts 136, 137 are initially joined by a plurality of frangible bridges 180 which will break if either: (i) the lower shell part 136 is rotated before initial opening; or, (ii) an attempt is made to pull the top part of the closure off without unscrewing. The bridges, therefore, serve as an additional tamper-evident feature.

As seen best in FIG. 10, the inner part 125 of the closure 110 extends beyond the split line 140 and the open end of the outer part to provide a dog-leg shape terminal portion 190 which rests on a shoulder 120*a* on the main body 120 so that one half 192 of the terminal portion fits beneath the upper end of the lower shell part 136 and the other half 194 fits in the upper shell part 137. Above the shell split line 140, a plurality of frangible bridges (not shown) are formed in the inner part 125 to form a split line 185.

Figure 14:
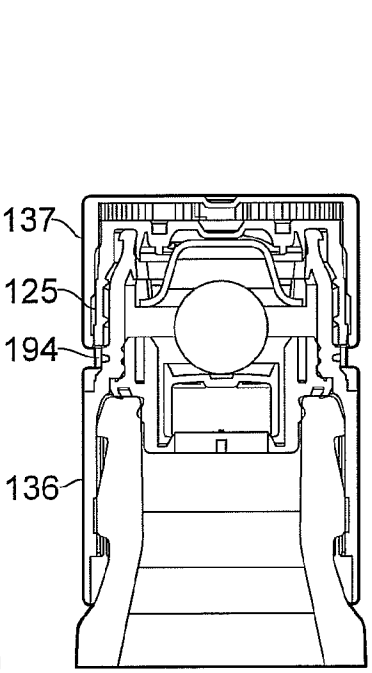
FIG. 14 is a section of the closure shown in FIGS. 9 to 13 shown in a closed position following an initial irreversible opening event.
Figure 13:
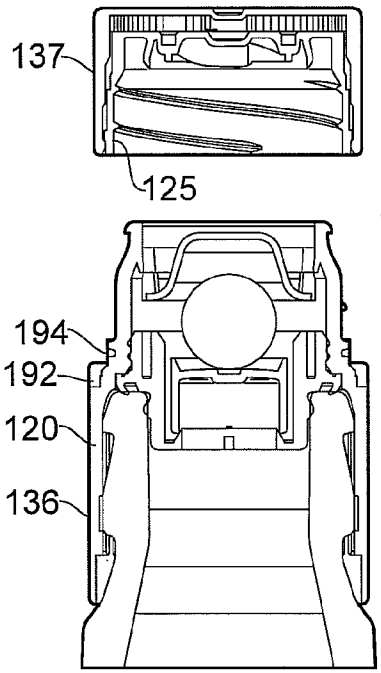
FIG. 13 is a section of the closure shown in FIG. 12.
Figure 12:
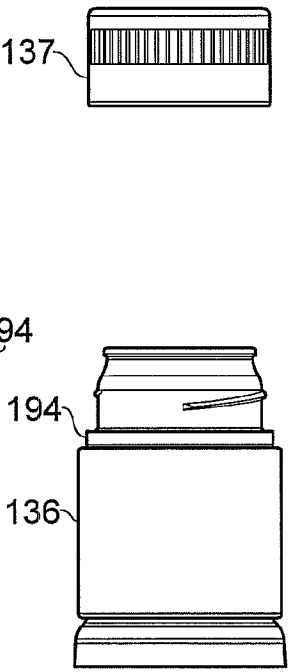
FIG. 12 is a side elevation of the closure of FIG. 11.
Figure 11:
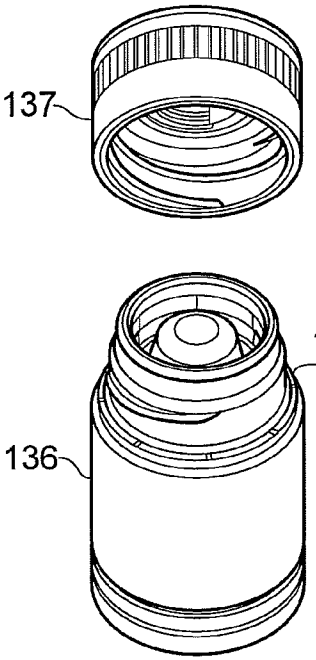
FIG. 11 is a perspective view of the closure of FIGS. 9 and 10 shown in an open position.
Figures 15, 16, 17, 18:
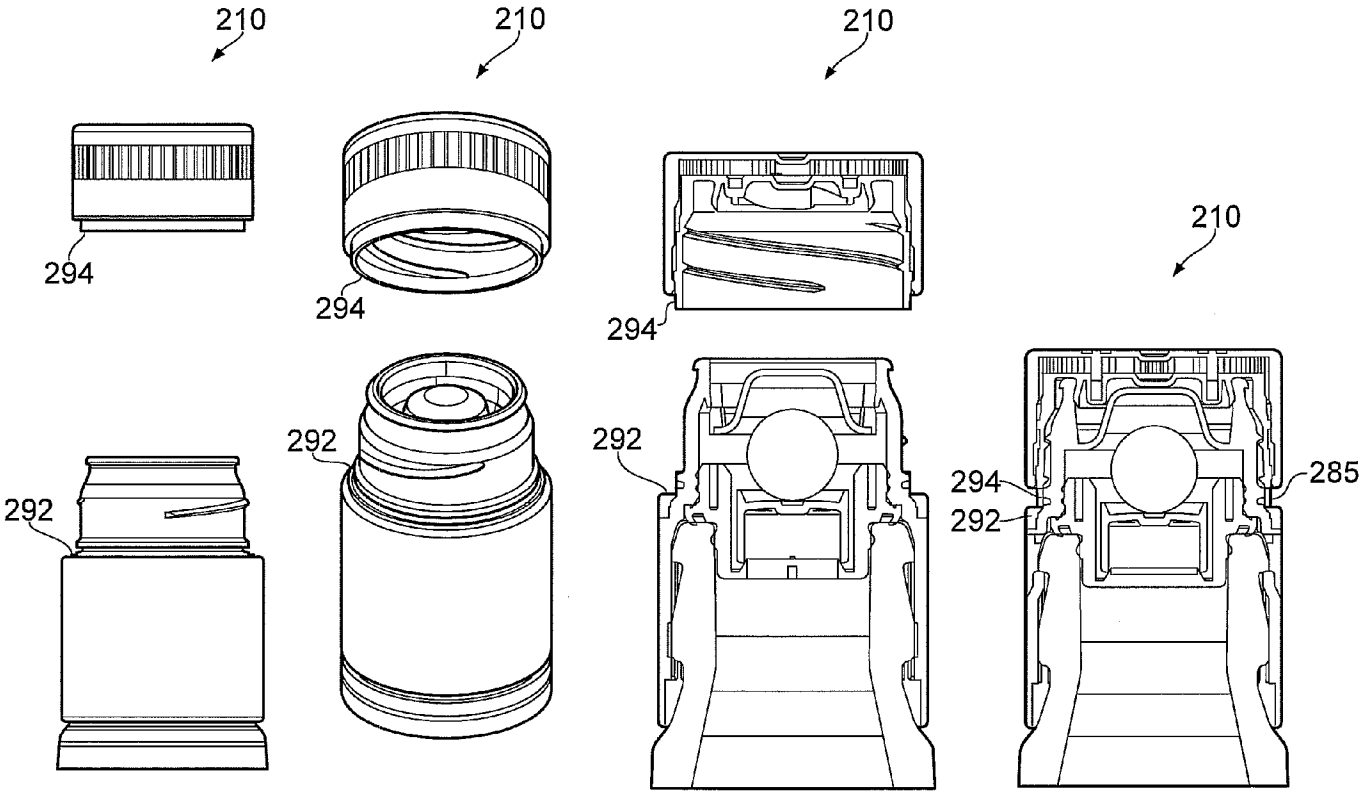
FIG. 15 is a side elevation of a closure formed according to an alternative embodiment and shown in an open position.
FIG. 16 is a perspective view of the closure shown in FIG. 15.
FIG. 17 is a section of the closure shown in FIGS. 15 and 16.
FIG. 18 is a section of the closure shown in FIGS. 15 to 17 shown in a closed position following an initial irreversible opening.

Referring now to FIGS. 11 to 13, in use, when the closure is opened the shell part 137 is unscrewed in the same way as that described for the closure 10. In this embodiment, however, the unscrewing action breaks both the bridges 180 on the split line 140 and those on the split line 185. The result is that the terminal portion 190 of the inner part remains held on the body so that the half 194 produces a visible upstanding band. When the top cap is replaced, as shown in FIG. 14, the band 194 is visible through the gap G.

FIGS. 15 to 21 show a closure 210 formed according to an alternative embodiment. The closure is very similar to the closure 110 and includes and extended inner part 225 which has a dog-leg shape terminal portion 290. In this embodiment a split line 285 is formed approximately in line with the split line 240 between the shell parts. The result is that in use instead of a band being retained on the lower part of the closure, the upper half 294 of the terminal portion 290 is removed with the top cap on first opening and projects below the open end of the cap so as to be clearly visible. When the closure is then returned to the closure position (FIG. 18), the portion half 294 is visible in the gap G.

Figure 19:
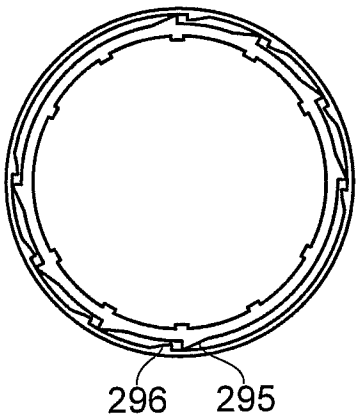
FIG. 19 is a perspective view of part of a closure body forming part of the closure shown in FIGS. 15 to 18 illustrating connection of an inner part terminal end portion.
Figure 20:
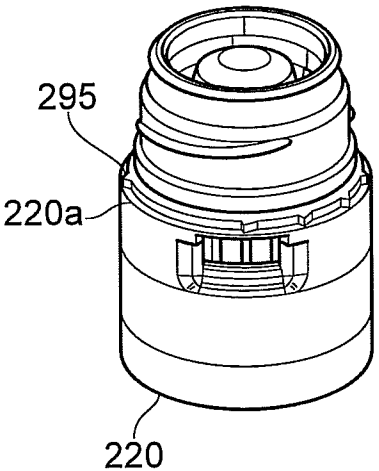
FIG. 20 is a perspective view of the closure body shown in FIG. 20.
Figure 21:
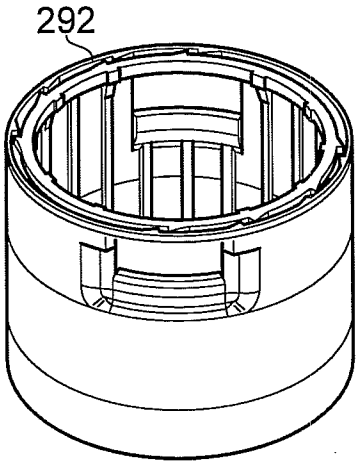
FIG. 21 is a plan view of the closure body/end portion shown in FIG. 19.

As is shown best in FIGS. 19 to 21, the terminal portion half 292 sits on the body shoulder 220*a*. The body wall extending from the shoulder 220*a* carries a plurality of ratchet teeth 295 for engaging a plurality of corresponding teeth 296 formed on the interior surface of the half 292. This prevents the half rotating relative to the body 220 in use and ensures breakage of the bridges formed along the split line 285. A similar arrangement is provided for the closure 110.

In the claims, means or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Having described at least one of the preferred embodiments of the present invention with reference to the accompanying drawings, it is to be understood that the invention is not limited to those precise embodiments, and that various changes, modifications, and adaptations may be effected therein by one skilled in the art without departing from the scope or spirit of the invention as defined in the appended claims.

The invention claimed is:

1. A tamper-evident closure for a container, the closure comprising:

(a) a first portion, said first portion further comprising:

(i) an inner part; and (ii) an outer part;

(b) a second portion, wherein said outer part is movable relative to said inner part from a first position wherein at least part of said first and said second portions are adjacent each other to a second position wherein there is a gap therebetween; and (c) locking means, within said first portion, for irreversibly locking said closure in said second position, upon first opening, so that said gap cannot be closed, and wherein said outer part includes a top plate and at least part of said locking means is carried on said first top plate.

2. A tamper-evident closure as claimed in claim 1, wherein: said inner part includes a second top plate and part of said locking means is carried on said second top plate.

3. A tamper-evident closure as claimed in claim 1, wherein: said locking means further comprises a longitudinal ratchet arrangement.

4. A tamper-evident closure as claimed in claim 1, wherein: said second portion is adapted to be connected to said container, and said first portion comprises a cap.

5. A tamper-evident closure as claimed in claim 1, wherein: said closure further comprises a non-return fitment.

6. A closure according claim 1, wherein: said first portion is adapted to engage an in-bore fitment associated with said container.

7. A tamper-evident closure according to claim 1, wherein: said closure further comprises blocking means for preventing said inner part from moving relative to said second portion until said inner part has reached said second position.

8. A tamper-evident closure according to claim 1, wherein: said gap is unobstructed.

9. A tamper-evident closure according to claim 1, wherein: said second portion is permanently fixed in a position on said container.

10. A tamper-evident closure according to claim 1, wherein: said first portion further comprises a lateral ratchet arrangement for locking said inner and said outer parts in said second position.

11. A tamper-evident closure according to claim 10, wherein: said first portion further comprises a set of engagement formations and said lateral ratchet arrangement is located above said set of engagement formations.

12. A tamper-evident closure according to claim 1, wherein: said gap is formed at the respective adjacent peripheries of said first portion and said second portion.

13. A tamper-evident closure according to claim 1, wherein: said inner part includes a part which extends beyond said outer part towards said second portion in said second position, and wherein the part is positioned so as to be visible through said gap.

14. A tamper-evident closure according to claim 1, wherein: said closure includes a metal shell.

15. A tamper-evident closure according to claim 14, wherein: said shell is associated with said first and said second portions and in which said gap is formed within said shell.

16. A tamper-evident closure for a container, said closure comprising:

(a) a first portion, said first portion further comprising:

a cap, said cap comprising:

an inner part; and an outer part, said outer part further comprising a first top plate;

(b) a second portion, wherein said outer part is movable relative to said inner part from a first position in which at least part of said first and second portions are adjacent each other to a second position in which there is a gap therebetween, and wherein said second portion is adapted to be connected to said container; and (c) locking means, within said first portion, for irreversibly locking said closure in said second position, upon first opening, so that said gap cannot be closed, said locking means further comprising a longitudinal ratchet arrangement, wherein at least part of said locking means is carried on said first top plate.

* * * * *